United States Patent [19]

Charnley et al.

[11] 4,104,670

[45] Aug. 1, 1978

[54] AUTOMATIC REPLENISHER CONTROL

[75] Inventors: Ralph L. Charnley, Minneapolis; Clyde A. Kumpula, Little Canada, both of

[73] Assignee: Pako Corporation, Minneapolis, Minn.

[21] Appl. No.: 785,840

[22] Filed: Apr. 8, 1977

[51] Int. Cl.[2] ..... G03D 13/00

[52] U.S. Cl. ..... 354/324; 354/298

[58] Field of Search ..... 354/297, 298, 324; 137/93, 624.15; 250/570, 573

[56] References Cited

U.S. PATENT DOCUMENTS

| | | | |
|---|---|---|---|
| 3,529,529 | 9/1970 | Schumacher | 354/297 |
| 3,559,555 | 2/1971 | Street | 354/298 |
| 3,561,344 | 2/1971 | Frutiger et al. | 354/298 |
| 3,696,728 | 10/1972 | Hope | 354/298 |
| 3,752,052 | 8/1973 | Hope et al. | 354/297 |
| 3,822,723 | 7/1974 | Crowell et al. | 354/297 |
| 3,905,698 | 9/1975 | Schroter et al. | 354/298 |
| 3,927,417 | 12/1975 | Kinoshita et al. | 354/298 |
| 4,057,818 | 11/1977 | Gaskell et al. | 354/298 |

*Primary Examiner*—L. T. Hix
*Assistant Examiner*—Alan Mathews
*Attorney, Agent, or Firm*—John W. Adams; David R. Fairbairn

[57] ABSTRACT

An automatic replenisher system for photographic processors has an improved, digital electronic control. The control includes sensors and signal processing circuitry which provide a signal having a frequency indicative of a measured parameter (such as film density or film transport speed) which is associated with the operation of the processor. A counter counts in response to the variable frequency signal. The counter is interrogated at predetermined intervals, and an energizing signal is produced. The energizing signal has a time duration which is determined by the count in the counter at the time of interrogation.

16 Claims, 2 Drawing Figures

AUTOMATIC REPLENISHER CONTROL

BACKGROUND OF THE INVENTION

The present invention relates to automatic replenisher systems for processors of photosensitive material. In particular, the present invention relates to an improved control system for controlling a replenisher which provides replenisher fluid to a processor.

Photographic processors require replenishment of the processing fluids to compensate for the lowered chemical activity of the fluid which results from processing of the photosensitive film or paper. Replenishment systems originally were manually operated. The operator would visually inspect the film being processed and would manually operate the replenisher systems as he deemed necessary. The accuracy of manual replenisher systems is obviously dependent upon the skill and experience of the operator.

In recent years, automatic replenishment systems have found increasing use. These systems typically utilize film density measurements and, in some cases, film speed measurements to control the operation of the replenishment system. Examples of previous automatic replenishment systems are shown in a patent application by Gaskell and Charnley, Ser. No. 590,078, now U.S. Pat. No. 4,057,818 filed June 25, 1975 and assigned to the same assignee as the present application, and in U.S. Pat. Nos. 3,529,529 by Shumacher, 3,559,555 by Street, 3,561,344 by Frutiger et al, 3,696,728 by Hope, 3,752,052 by Hope et al, 3,822,723 by Crowell et al, and 3,927,417 by Kinoshita et al.

The prior art automatic replenisher systems may be characterized generally as analog electrical or electromechanical systems. As a result, they are generally difficult to calibrate, are subject to drift, and are relatively complex electrically or mechanically. There is a continuing need for simpler, more reliable automatic replenishment systems.

SUMMARY OF THE INVENTION

The present invention is an improved control system for controlling a replenisher which provides replenisher fluid to a processor of photosensitive material. The control system includes means for providing a signal having a frequency indicative of a measured parameter associated with operation of the processor. Counter means counts in response to the variable frequency signal, and interrogate means interrogates the counter means at predetermined intervals. An energizing signal is provided to the replenisher at the predetermined intervals. The time duration of the energizing signal is determined by the count in the counter means when the counter means is interrogated.

DETAILED DESCRIPTION OF THE PREFERRED EMBODIMENT

Figure 1:
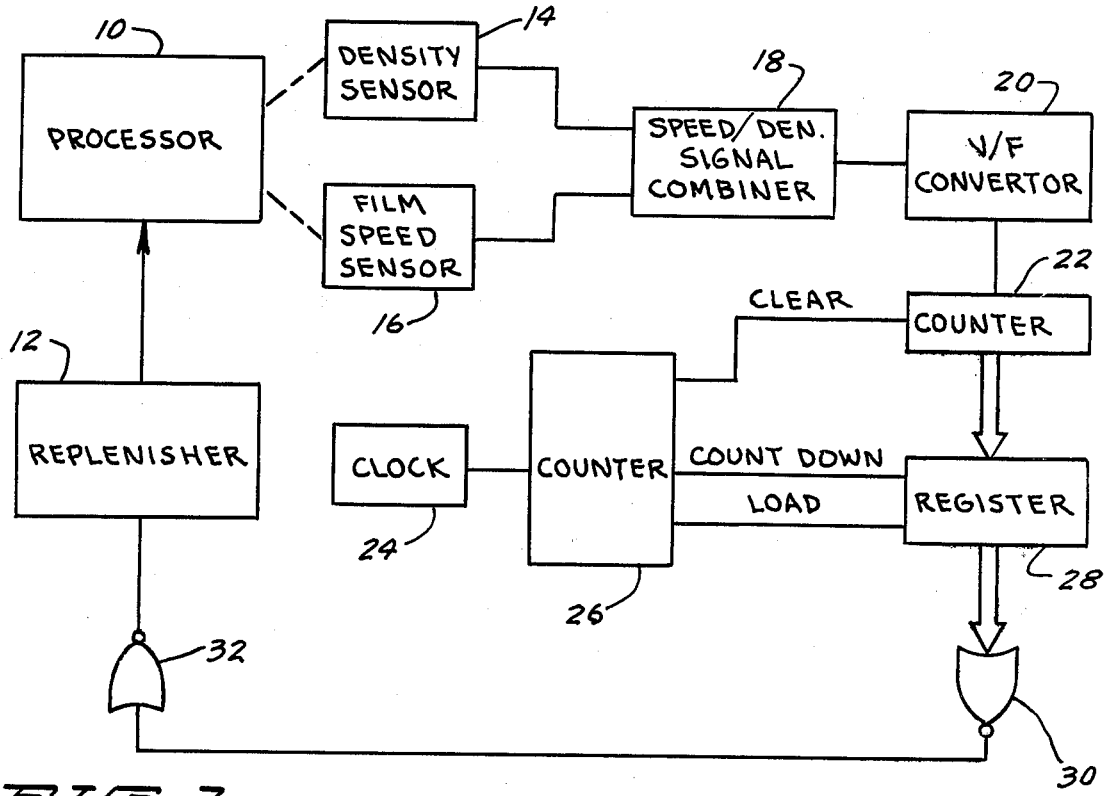
FIG. 1 is a block diagram of the control system of the present invention.

FIG. 1 shows a block diagram of a replenishment system which includes the control circuit of the present invention. A processor 10 of photosensitive material has its processor fluid replenished by replenisher 12. Both processor 10 and replenisher 12 may take any one of many well-known forms, such as those shown in the previously mentioned patent application and patents.

In the embodiment shown in FIG. 1, two parameters relating to the processing occurring in processor 10 are sensed. Density sensor 14 senses the density of the developed film and produces a density signal proportional to the image density of the developed film. Film speed sensor 16 senses the speed of which film is being transported through the processor 10. In the preferred embodiments, film speed sensor 16 provides a film speed signal which is proportional to the film speed through the processor 10.

Speed/density signal combiner 18 receives the density signal from density sensor 14 and the film speed signal from film speed sensor 16. These two signals are combined by speed/density signal combiner 18 to provide a combined signal. In one preferred embodiment, the combined signal is the product of the density signal and the film speed signal, and speed/density signal combiner 18 is a multiplier which multiplies the density and film speed signals.

The combined signal from speed/density signal combiner 18 is received by voltage-to-frequency converter 20. The voltage-to-frequency converter 20 produces a variable frequency signal whose frequency is indicative of the measured parameters (density and film speed).

The variable frequency signal drives counter 22, which, in a preferred embodiment, counts up in response to the variable frequency signal. Counter 22 is interrogated at predetermined intervals by interrogate means formed by clock 24, counter 26, and register 28. Counter 26, which is driven by clock 24, has outputs which provide a clear signal, a load signal, and a count-down signal.

The load signal is provided to register 28 at the predetermined intervals. In one preferred embodiment, the load signal is provided every 30 seconds and has a 30 msec duration. The load signal causes register 28 to accept the count then contained in counter 22.

The clear signal is a short duration signal which immediately follows the load signal. The clear signal resets counter 22 after the count in counter has been loaded in register 28. In the preferred embodiment in which counter 22 counts up in response to the variable frequency signal from voltage frequency converter 20, the clear signal resets counter 22 to zero.

The count-down signal causes register 28 to count down from the count which has been transferred from counter 22 to register 28. The time required for register 28 to count down to zero in response to the count-down signal is, of course, determined by the count which has been loaded from counter 22.

NOR gate 30 receives all of the outputs of register 28. The output of NOR gate 30 is "O" only during the time that register 28 has a non-zero count. Gate 32 is a driver or interface gate which provides an energizing signal to replenisher 12. In the circuits shown in FIG. 1, the energizing signal is applied to replenisher 12 only during the time when the output of NOR gate 30 is "O". In other words, the energizing signal is applied for the time duration required by the register 28 to count down to zero from the count received from the counter 22.

The operation of the control system of the present invention, therefore, is based upon the production of a variable frequency signal (by density sensor 14, film speed sensor 16, speed/density signal combiner 18, and voltage-to-frequency converter 20) which has a frequency indicative of a measured parameter or parameters associated with operation of the processor 10. This variable frequency signal drives counter 22, which is interrogated at predetermined intervals (for example, every 30 seconds) by clock 24, counter 26, and register 28. An energizing signal is applied to replenisher 12 through gates 30 and 32. The time duration of the energizing signal is determined by the count in counter 22 when it is interrogated.

The time duration of the energizing signal can, conceivably, vary from zero seconds to approximately 30 seconds, which is the predetermined interval between interrogation. The zero second duration (i.e. no energization of replenisher 12) can occur if the density sensor 14 or film speed sensor 16 indicates that no replenishment is required so that the frequency of the variable frequency signal is zero. This may occur, for example, if no film is being passed through processor 10.

The maximum time duration of the energizing signal to replenisher 12 is determined by the maximum count which can be stored in counter 22 and register 28 and by the frequency of the count-down signal. In no case is the maximum time duration greater than the predetermined interval, and in many cases it is less than the predetermined interval.

Figure 2:
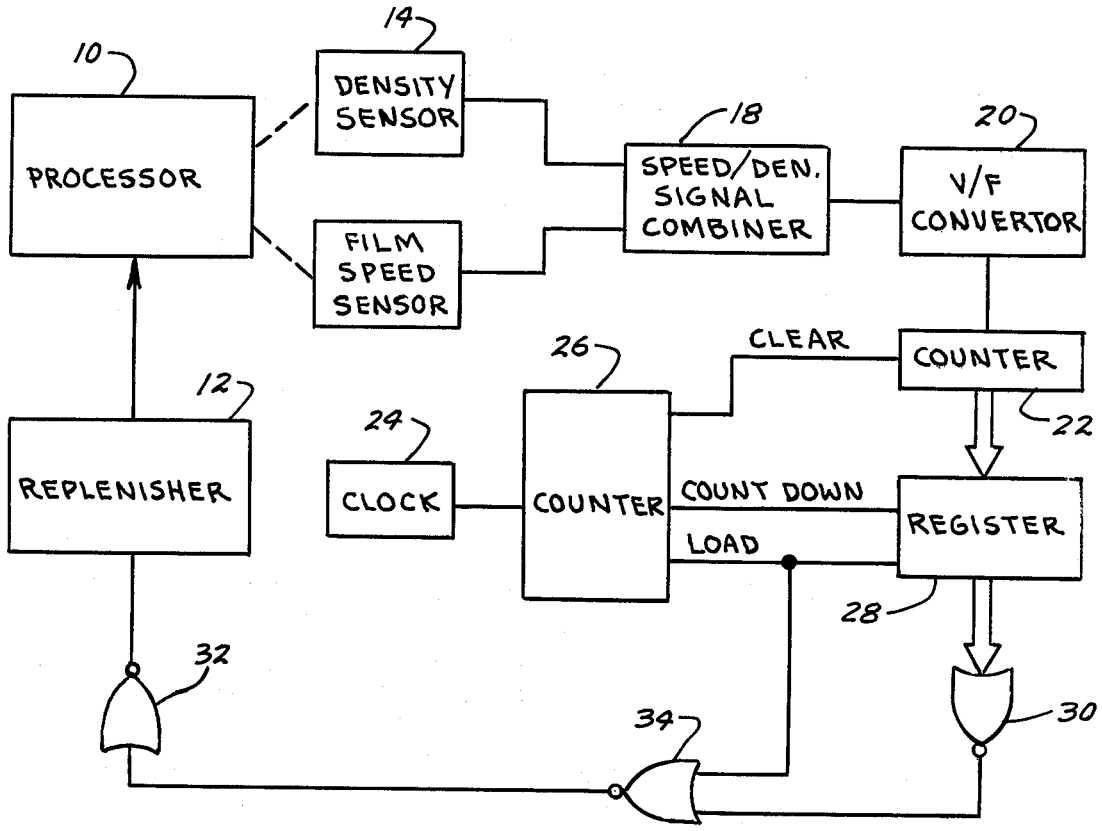
FIG. 2 is a block diagram of another embodiment of the control system of the present invention.

FIG. 2 shows another embodiment of the present invention which is generally similar to the system shown in FIG. 1. For that reason, similar numerals have been used to designate similar elements.

The system of FIG. 2 differs from the system of FIG. 1 in that an additional NOR gate 34 has been added. NOR gate 34 NORs the output of NOR gate 30 with the load signal. The output of NOR gate 34 is then applied to gate 32, which in turn provides the energizing signal to replenisher 12. The purpose of NOR gate 34 is to provide a short energization of replenisher 12 at the predetermined intervals even if counter 22 contains a zero count and the output of NOR gate 30 does not go to zero during that interval. Under some circumstances, this energization of replenisher 12 at regular time intervals is advantageous, as specifically discussed in the previously mentioned co-pending patent application by Gaskell and Charnley.

In one preferred embodiment, the load signal has a pulse of approximately 30 msec. If this duration of energizing signal is not desired, additional circuitry can be added to the circuit of FIG. 2 to either increase or decrease the duration of the load signal applied to NOR gate 34.

The control circuit of the present invention has several important advantages over the prior art replenisher control systems. First, it is easier to calibrate than the prior art analog electrical or electromechanical systems. Second, it is not subject to drift problems. Third, the system of the present invention uses fewer and less complex components than the prior art systems. This results in lower cost and greater reliability than the prior art systems. Fourth, the control circuit of the present invention greatly simplifies power supply requirements, since it requires a single, relatively low voltage to operate the digital electronics and does not require a two-phase clock. Fifth, the control circuit of the present invention greatly simplifies the requirements for the signal processing of the speed and density signals.

In conclusion, the control system of the present invention provides highly accurate, reliable replenisher system control with greatly reduced system complexity, system cost, and number of components. Although the present invention has been described with reference to certain preferred embodiments, workers skilled in the art will recognize that changes may be made in form and detail without departing from the spirit and scope of the invention.

What is claimed is:

1. A control system for controlling replenisher means to provide replenisher fluid to a processor of photosensitive material, the control system comprising:

variable frequency signal providing means for providing a variable frequency signal having a frequency indicative of a measured parameter associated with operation of the processor;

counter means for counting in response to the variable frequency signal;

interrogate means for interrogating the counter means at predetermined intervals; and energizing signal providing means for providing an energizing signal to the replenisher means, the energizing signal having a time duration determined by the count in the counter when the counter means is interrogated.

2. The control system of claim 1 and further comprising:

reset means for resetting the counter means after each interrogation by the interrogate means.

3. The control system of claim 2 wherein the interrogate means comprises:

load signal providing means for providing a load signal at the predetermined intervals; and register means for receiving a count from the count means in response to the load signal.

4. The control system in claim 3 wherein the energizing signal providing means comprises:

count signal providing means for providing count signals to the register means to cause the register means to count from the count received from the counter means to a predetermined count in response to the count signals; and means for providing the energizing signal to the replenisher means for a time duration required for the register means to count from the count received from the counter means to the predetermined count.

5. A control system for controlling replenisher means to provide replenisher fluid to a processor of photosensitive material, the control system comprising:

means for providing a variable frequency signal having a frequency indicative of a measured parameter associated with operation of the processor;

first counter means for counting in response to the variable frequency signal;

register means for receiving a count from the first counter means in response to a load signal and counting from the received count to a predetermined count in response to count signals;

load signal providing means for providing the load signal to the register means at predetermined intervals;

count signal providing means for providing the count signals to the register means;

reset means for providing a clear signal to the first counter means to reset the first counter means after the register means has received a count from the first counter means; and means for providing an energizing signal to the replenisher for a time duration required for the register means to count from the received count to the predetermined count.

6. The control system of claim 5 wherein the means for providing a variable frequency signal comprises:

means for providing a signal having a voltage indicative of a measured parameter associated with the operation of the processor; and voltage-to-frequency converter means for receiving the signal and providing the variable frequency signal.

7. The control system of claim 6 wherein the means for providing a signal having a voltage indicative of a measured parameter comprises:

density measuring means for measuring density of processed photosensitive material and providing a density signal indicative of measured density.

8. The control system of claim 7 wherein the means for providing a signal having a voltage indicative of a measured parameter further comprises:

photosensitive material speed measuring means for providing a speed signal indicative of speed of photosensitive material being transported through the processor; and speed/density signal combiner means for combining the speed signal and the density signal to provide a signal to the voltage-to-frequency converter means.

9. The control system of claim 5 wherein the load signal providing means comprises:

clock means for providing clock signals; and second counter means for counting in response to the clock signals, the second counter means having a first output for providing the load signal to the register means.

10. The control system of claim 9 wherein the reset means also comprises the clock means and the second counter means and wherein the second counter means has a second output for providing the clear signal to the first counter means.

11. The control system of claim 10 wherein the count signal providing means also comprises the clock means and the second counter means and wherein the second counter means has a third output for providing the count signals to the register means.

12. The control system of claim 5 wherein the clear signal resets the first counter means to zero.

13. The control system of claim 12 wherein the predetermined count is zero.

14. The control system of claim 13 wherein the count signals cause the register means to count down from the received count to zero.

15. The control system of claim 14 wherein the means for providing an energizing signal provides the energizing signal when the register means has a non-zero count.

16. The control system of claim 15 wherein the means for providing an energizing signal comprises:

NOR gate means for NORing outputs of the register means.

* * * * *